US010655513B2

(12) United States Patent
Ohshima et al.

(10) Patent No.: US 10,655,513 B2
(45) Date of Patent: May 19, 2020

(54) OIL PAN

(71) Applicant: Mazda Motor Corporation, Aki-gun, Hiroshima (JP)

(72) Inventors: Hirofumi Ohshima, Hiroshima (JP); Naoki Shida, Hiroshima (JP)

(73) Assignee: Mazda Motor Corporation, Aki-gun, Hiroshima (JP)

( * ) Notice: Subject to any disclaimer, the term of this patent is extended or adjusted under 35 U.S.C. 154(b) by 0 days.

(21) Appl. No.: 16/108,643

(22) Filed: Aug. 22, 2018

(65) Prior Publication Data

US 2019/0063277 A1 Feb. 28, 2019

(30) Foreign Application Priority Data

Aug. 25, 2017 (JP) ..... 2017-162862

(51) Int. Cl.
*F01M 11/00* (2006.01)

(52) U.S. Cl.
CPC ... *F01M 11/0004* (2013.01); *F01M 2011/002* (2013.01); *F01M 2011/0012* (2013.01); *F01M 2011/0091* (2013.01)

(58) Field of Classification Search
CPC ..... F01M 11/0004; F01M 2001/002
USPC ..... 123/198 E
See application file for complete search history.

(56) References Cited

U.S. PATENT DOCUMENTS

2008/0311341 A1* 12/2008 Lee ..... F01M 11/0004 428/119
2010/0139606 A1* 6/2010 Yorita ..... F01M 11/0004 123/192.2
2012/0251788 A1* 10/2012 Hanley ..... F01M 11/0004 428/167
2015/0184562 A1 7/2015 Sato et al.

FOREIGN PATENT DOCUMENTS

JP S58030707 U 2/1983
JP H4132445 U 12/1992
JP 2015124647 A 7/2015

* cited by examiner

*Primary Examiner* — Joseph J Dallo
*Assistant Examiner* — Yi-Kai Wang
(74) *Attorney, Agent, or Firm* — Alleman Hall Creasman & Tuttle LLP

(57) ABSTRACT

An oil pan for trapping oil of an engine comprising: a curved portion connecting a flat portion and a side wall portion and including a rib-free region where a first reinforcing rib provided on the flat portion and a second reinforcing rib provided on the side wall portion are not connected to each other.

5 Claims, 13 Drawing Sheets

OIL PAN

CROSS-REFERENCE TO RELATED APPLICATION

This application claims priority to Japanese Patent Application No. 2017-162862 filed on Aug. 25, 2017, the entire disclosure of which is incorporated by reference herein.

BACKGROUND

The present disclosure relates to an oil pan for trapping oil of an engine.

To improve the strength of the oil pan for trapping oil of an engine, reinforcing ribs have been provided on an outer surface of the oil pan (see, e.g., Japanese Utility Model Publication No. H4-132445).

Japanese Utility Model Publication No. H4-132445 discloses a technique of providing reinforcing ribs continuously in a grid shape on a bottom wall portion and a side wall of inner and outer surfaces of a resin oil pan to reduce noises caused by vibration of the resin oil pan and prevent distortion caused by heat of the oil pan.

SUMMARY

However, the inventors have studied and found that even the oil pan of Japanese Utility Model Publication No. H4-132445 still generates a loud radiated sound due to the deformation of the oil pan during operation of the engine, and there is room for improvement.

In view of the foregoing, it is an object of the present disclosure to provide an oil pan for trapping oil of an engine, the oil pan capable of having increased strength and having the radiated sound reduced.

In this disclosure, to achieve the object, the reinforcing ribs are not formed in the curved portion connecting a flat portion and a side wall portion, and a rib-free region where a plurality of first reinforcing ribs provided on the flat portion and a plurality of second reinforcing ribs provided on the side wall portion are not connected to each other.

That is, the oil pan disclosed herein is an oil pan for trapping oil of an engine, comprising: a flat portion formed to extend in a substantially horizontal direction and having an outer surface on which a plurality of first reinforcing ribs are provided; a curved portion smoothly connected to the flat portion; and a side wall portion connected to a side, of the curved portion, opposite to the flat portion, extending in a substantially vertical direction, and having an outer surface on which a plurality of second reinforcing ribs are provided. The curved portion includes a rib-free region on which no reinforcing ribs are provided. The first reinforcing rib and the second reinforcing rib are not connected to each other in the rib-free region.

According to this configuration, the curved portion includes the rib-free region. Thus, the deformation of the entirety of the oil pan during the operation of the engine is reduced, and also the radiated sound can be reduced.

Preferably, the first reinforcing ribs are formed in a lattice shape, and the second reinforcing ribs are a plurality of line-shaped ribs provided in parallel with each other in a substantially vertical direction along a surface of the side wall portion.

This configuration allows the first reinforcing ribs to reinforce the flat portion more effectively, and also allows the second reinforcing ribs to reinforce the side wall portion more effectively. Then, the moldability can be improved.

In a preferred embodiment, the engine is a multi-cylinder engine including a plurality of cylinders arranged in series, the oil pan is provided below a cylinder block of the engine to extend to both ends of a cylinder line direction, and the flat portion has a plurality of flat regions each having a different distance from a lower end of the cylinder block.

According to this configuration, the flat portion has a plurality of flat regions each having a different distance from the lower end of the cylinder block. This can provide an oil pan capable of compactly trapping oil in accordance with the engine layout. Each flat region has the first reinforcing ribs, and thus the flat portion has improved strength.

Preferably, on the flat portion and the side wall portion located on a side opposite to an output side of a crankshaft of the engine, provided are the first reinforcing ribs and the second reinforcing ribs each having a rib height larger than a rib height of each of the other reinforcing ribs.

According to this configuration, the reinforcing ribs each having a larger rib height can appropriately reduce the deformation of the portions, of the oil pan, on the side opposite to the output side of the crankshaft.

In a preferred embodiment, the rib-free region of the curved portion is formed to be curved in an outwardly raised manner.

According to this configuration, the curved portion includes the outwardly raised curved portion having the rib-free region where the first reinforcing rib and the second reinforcing rib are not connected to each other. This can effectively reduce the deformation of the oil pan and reduce the radiated sound.

In the above configuration, preferably, a part of the curved portion is curved to include a recessed portion facing toward an inside of the oil pan, and further has a reinforcing rib forming region having an outer surface on which third reinforcing ribs are formed, and the third reinforcing ribs extend from the second reinforcing ribs and are connected to the first reinforcing ribs.

This configuration can improve the strength of the oil pan, and increase the moldability of the oil pan.

As described above, according to the present disclosure, the curved portion includes the rib-free region. Then, the deformation of the entirety of the oil pan during the operation of the engine is reduced, and also the radiated sound can be reduced.

DETAILED DESCRIPTION

Embodiments of the present disclosure will be described in detail below with reference to the drawings. The following embodiments are merely exemplary ones in nature, and are not intended to limit the scope, applications, or use of the disclosure.

First Embodiment

<Vehicle and Direction>

Figure 1:
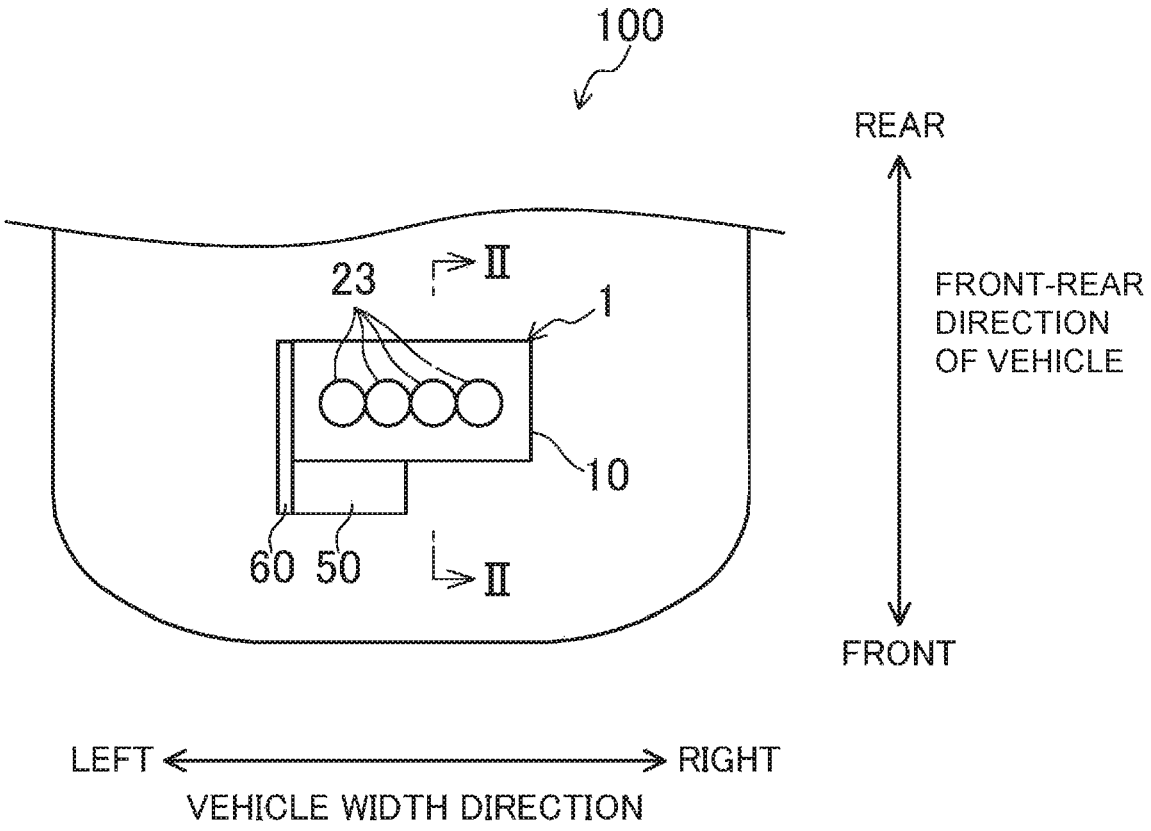
FIG. 1 is a schematic plan view of a vehicle in which an engine having an oil pan according to one embodiment is mounted.
Figure 2:
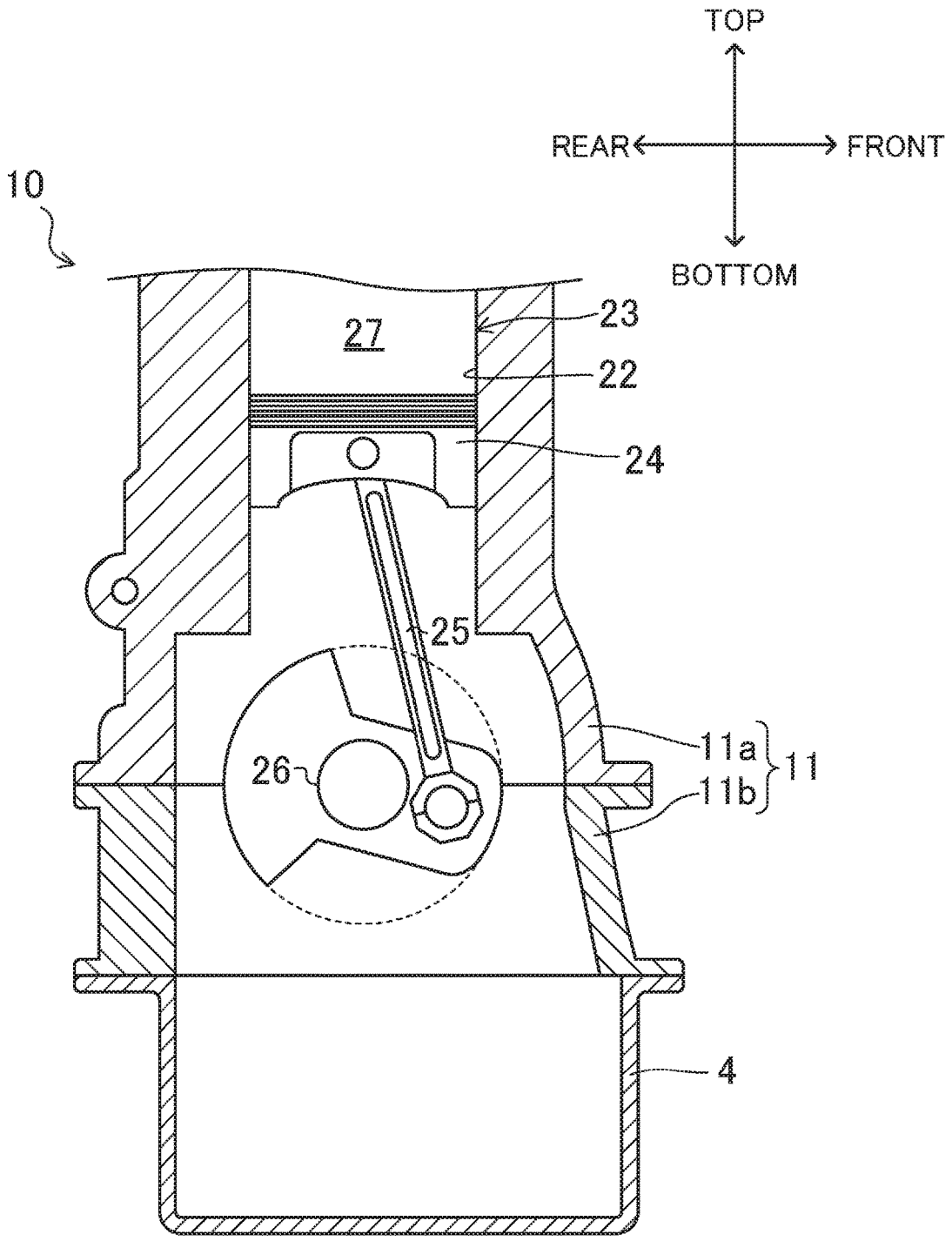
FIG. 2 is a schematic cross-sectional view taken along the line II-II of FIG. 1.

FIG. 1 is a schematic plan view of a front portion of a vehicle 100 in which an engine 1 having an oil pan 4 according to this embodiment is mounted. FIG. 2 is a partial cross-sectional view taken along line II-II of an engine body 10 of FIG. 1.

The vehicle 100 is configured as a front-engine/front-drive type vehicle (an FF vehicle). Note that the oil pan 4 according to this embodiment can be applied to an engine mounted not only on the FF vehicle but also on a front-engine/rear-drive (FR) vehicle, a mid-engine/rear-drive (MR) vehicle, a rear-engine/rear-drive (RR) vehicle, or the like.

In this specification, the directions are based on the vehicle 100 standing on a road surface. Specifically, as illustrated in FIG. 1, the "front-rear direction" is identical to the front-rear direction of the vehicle 100. The "left-right direction" is identical to the vehicle width direction of the vehicle 100, as illustrated in FIG. 1. As will be described later, the engine 1 is mounted in a "horizontal orientation." The output side (the side connected to the transmission) of a crankshaft of the engine 1 is referred to as the right side, and the side opposite to the output side of the crankshaft is referred to as the left side. The "horizontal direction" is a direction horizontal with respect to the road surface, and is a concept including the "front-rear direction" and the "left-right direction." The "top-bottom direction" is a direction perpendicular to the "front-rear direction" and the "left-right direction." Note that the "top-bottom direction" is identical to a direction vertical with respect to the road surface, and may be referred to as "vertical direction."

In this specification, the "substantially horizontal direction" and the "substantially vertical direction" include directions completely horizontal and completely vertical to the road surface, respectively, and are concepts allowing the inclination of approximately ±15° from the completely horizontal and completely vertical directions, respectively.

<Engine>

The engine 1 mounted on the vehicle 100 is a multi-cylinder internal combustion engine. Specifically, the engine 1 disclosed herein is an in-line four-cylinder gasoline engine. The engine 1 is mounted in the "horizontal orientation" in which the cylinder line direction and the left-right direction substantially coincide.

Note that the oil pan 4 according to this embodiment may be applied to not only the in-line four-cylinder gasoline engine but also a single-cylinder engine, another multi-cylinder engine, a diesel engine, or the like. The engine may be mounted not only in the transverse manner but also in a vertical orientation. Further, the oil pan 4 may be applied not only to the FF vehicle but also to an FR vehicle, an MR vehicle, an RR vehicle, or the like.

As illustrated in FIG. 1, the engine 1 includes the engine body 10. As illustrated in FIG. 2, the engine body 10 includes a cylinder block 11 and a cylinder head (not shown) provided above the cylinder block 11. Various members including a plurality of accessories 50 are attached to an outer wall of the engine body 10.

As illustrated in FIG. 2, the cylinder block 11 includes a cylinder block body 11*a* and a ladder frame 11*b* provided below the cylinder block body 11*a*. A cylinder bore 22 of a cylinder 23 is formed in the cylinder block main body 11*a*, and a piston 24 moves up and down in the cylinder bore 22. An upper surface of the piston 24, a wall surface of the cylinder bore 22, and a wall surface of the cylinder head constitute a combustion chamber 27. The piston 24 is connected to a crankshaft 26 provided at a lower portion of the cylinder block 11 via a connecting rod 25, and the power obtained by combustion of an air-fuel mixture in the combustion chamber 27 is transmitted to the outside via the crankshaft 26.

<Accessories>

A plurality of accessories 50 illustrated in FIG. 1 are peripheral devices provided to assist the engine operation of the engine body 10 and specifically including, e.g., a supercharger, an alternator, an air compressor for air conditioning, or the like. In addition to the accessories 50 illustrated in FIG. 1, the engine 1 is provided with a water pump for circulating engine cooling water, an intake device, an exhaust device, a fuel injection device, a starting device, and the like as various accessories.

<Accessory Drive System>

As illustrated in FIG. 1, an accessory drive system 60 configured to drive the engine body 10 and the accessories 50 in conjunction with each other is installed on a longitudinal end of the crankshaft 26.

The accessory drive system 60 includes a crankshaft pulley (not shown) provided with the crankshaft, an accessory drive pulley provided in the auxiliary machine 50, and a belt (not shown) wound therearound. The accessories 50 are driven, via the accessory drive system 60, by using the power obtained from the crankshaft 26.

<Oil Pan>

As illustrated in FIG. 2, the oil pan 4 of the cylinder block 11 is provided below the cylinder block 11, i.e., provided on a lower end of the ladder frame 11*b* (the lower end of the cylinder block) to trap the oil of the engine 1. Although not shown, the oil pan 4 is provided to extend to both ends of the cylinder line direction. In the following description, the side, of the oil pan 4, that traps the oil is referred to as the inside, and the opposite side is referred to as the outside. The configuration of the oil pan 4 will be described in detail with reference to FIGS. 3 to 15.

Figure 6:
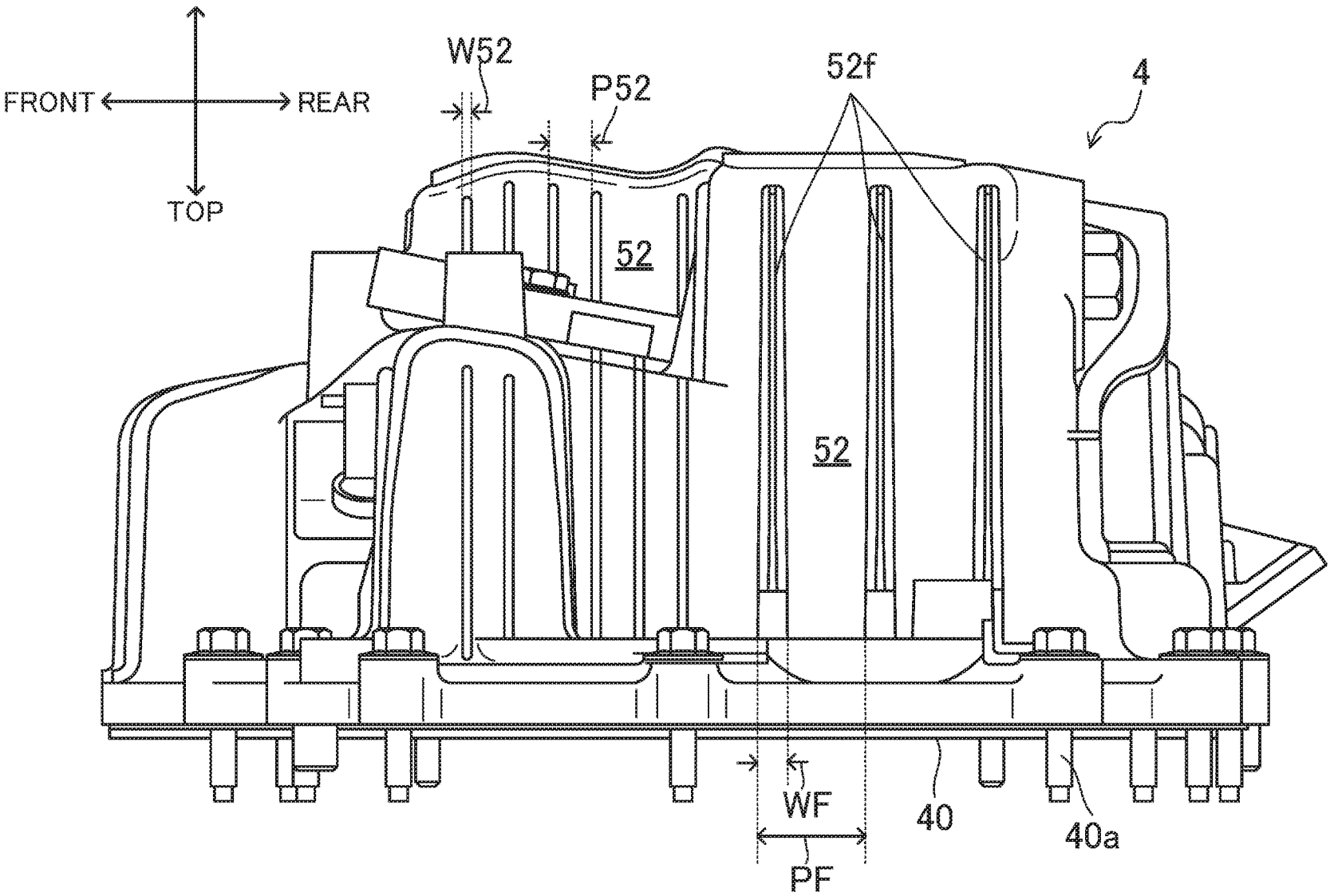
FIG. 6 is a front view of the oil pan of FIG. 3 as viewed from the left side.

Specifically, as illustrated in FIG. 6, the oil pan 4 is mounted by bolting an upper end of the oil pan 4 to the lower end of the ladder frame 11*b* with a fastening bolt 40*a* via a gasket (not shown). The oil trapped in the oil pan 4 is circulated and supplied to the entirety of the engine 1 through an oil passage provided in the engine 1.

The material of the oil pan 4 may be metal such as aluminum alloy, or resin such as fiber reinforced resin (e.g., polyamide, polyethylene terephthalate, or the like) containing glass fiber or carbon fiber, and is preferably glass fiber reinforced polyamide resin in terms of weight reduction and cost saving of the vehicle. The oil pan 4 may be manufactured by die molding such as injection molding.

As illustrated in FIGS. 3 to 6, the oil pan 4 includes a flat portion 41 formed to extend in the substantially horizontal direction and a side wall portion 42 formed to extend in the substantially vertical direction. A curved portion 43 is smoothly connected to a peripheral portion of the flat portion 41, and the side wall portion 42 is connected to the side, of the curved portion 43, opposite to the flat portion 41, and extends in the substantially vertical direction. The thicknesses of the flat portion 41, the side wall portion 42, and the curved portion 43 of the oil pan 4 can be appropriately changed depending on the material of the oil pan 4, and the thickness of the thinnest portion may be, e.g., 2 mm or more and 3 mm or less to be suitable for both strength improvement and weight reduction.

A plurality of first reinforcing ribs 51 formed in a grid shape and a line shape are provided on substantially the entire region of the outer surface of the flat portion 41. The first reinforcing ribs 51 are for improving the strength of the oil pan 4. The shape of the first reinforcing ribs 51 may be not only the grid shape or the line shape but also another shape such as a honeycomb shape or the like. The flat portion 41 corresponding to the bottom wall of the oil trapping portion is preferably provided with the first reinforcing ribs 51 formed in the grid shape in terms of the strength improvement.

Figure 8:
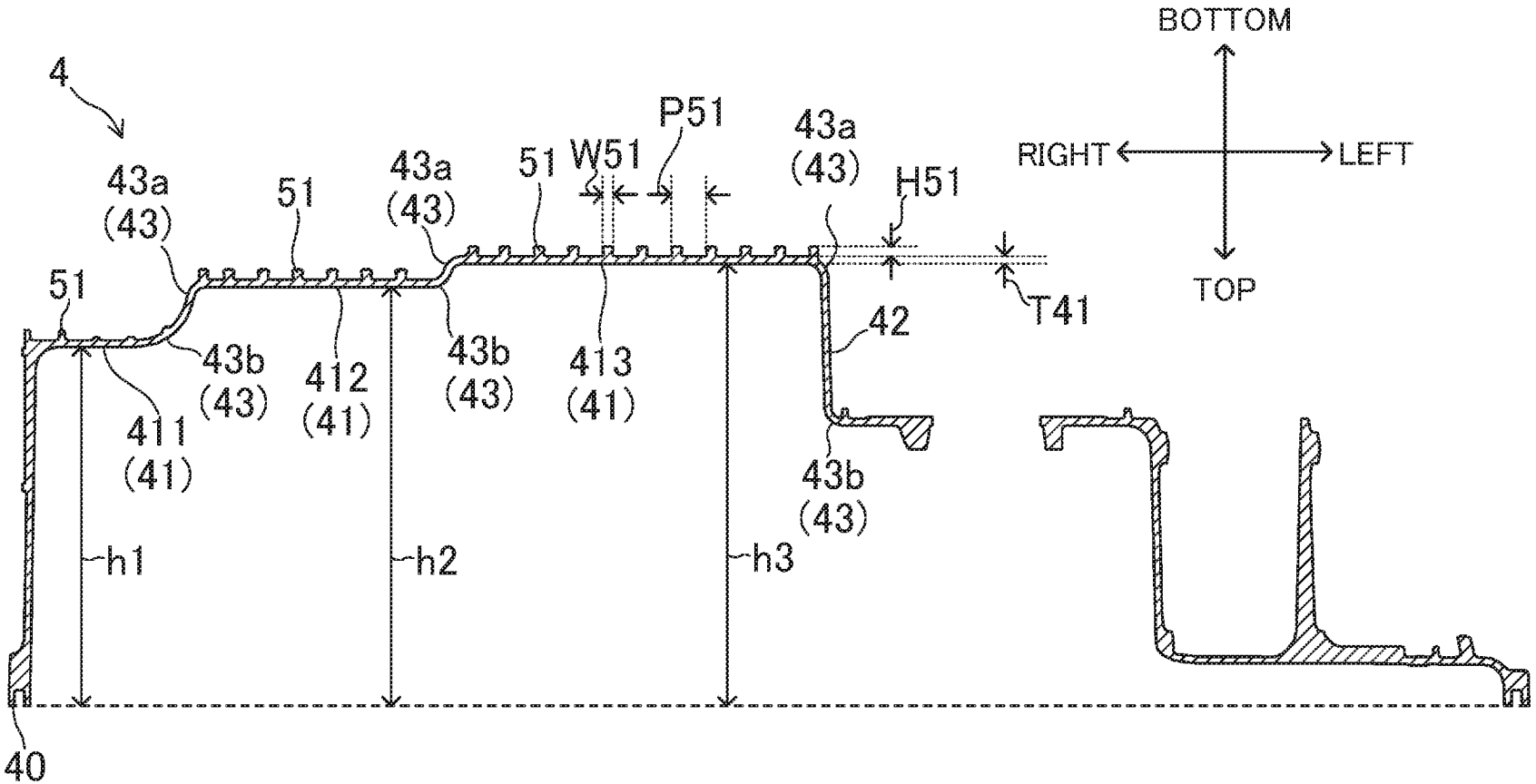
FIG. 8 is a cross-sectional view taken along the line VIII-VIII of FIG. 5.

As illustrated in FIG. 8, in the oil pan 4 according to this embodiment, a height H51 of the first reinforcing ribs 51, i.e., the height in the top-bottom direction from the outer surface of the flat portion 41 is 3 to 5 mm, which is approximately 1.2 times larger than a thickness T41 of the flat portion 41. Thus, the maximum thickness of the portion, of the flat portion 41, where the first reinforcing ribs 51 are provided is approximately 2.2 times larger than the thickness of the portion where the first reinforcing ribs 51 are not provided.

As illustrated in FIG. 8, in the oil pan 4 according to this embodiment, a width W51 of the first reinforcing ribs 51, i.e., the maximum width of the first reinforcing ribs 51 in the horizontal direction is approximately 1.2 times larger than a thickness T41 of the flat portion 41 in the top-bottom direction.

Further, as illustrated in FIG. 8, in the oil pan 4 according to this embodiment, a pitch P51 of the first reinforcing ribs 51 is approximately three times larger than the width W51 of the first reinforcing ribs 51.

Figure 7:
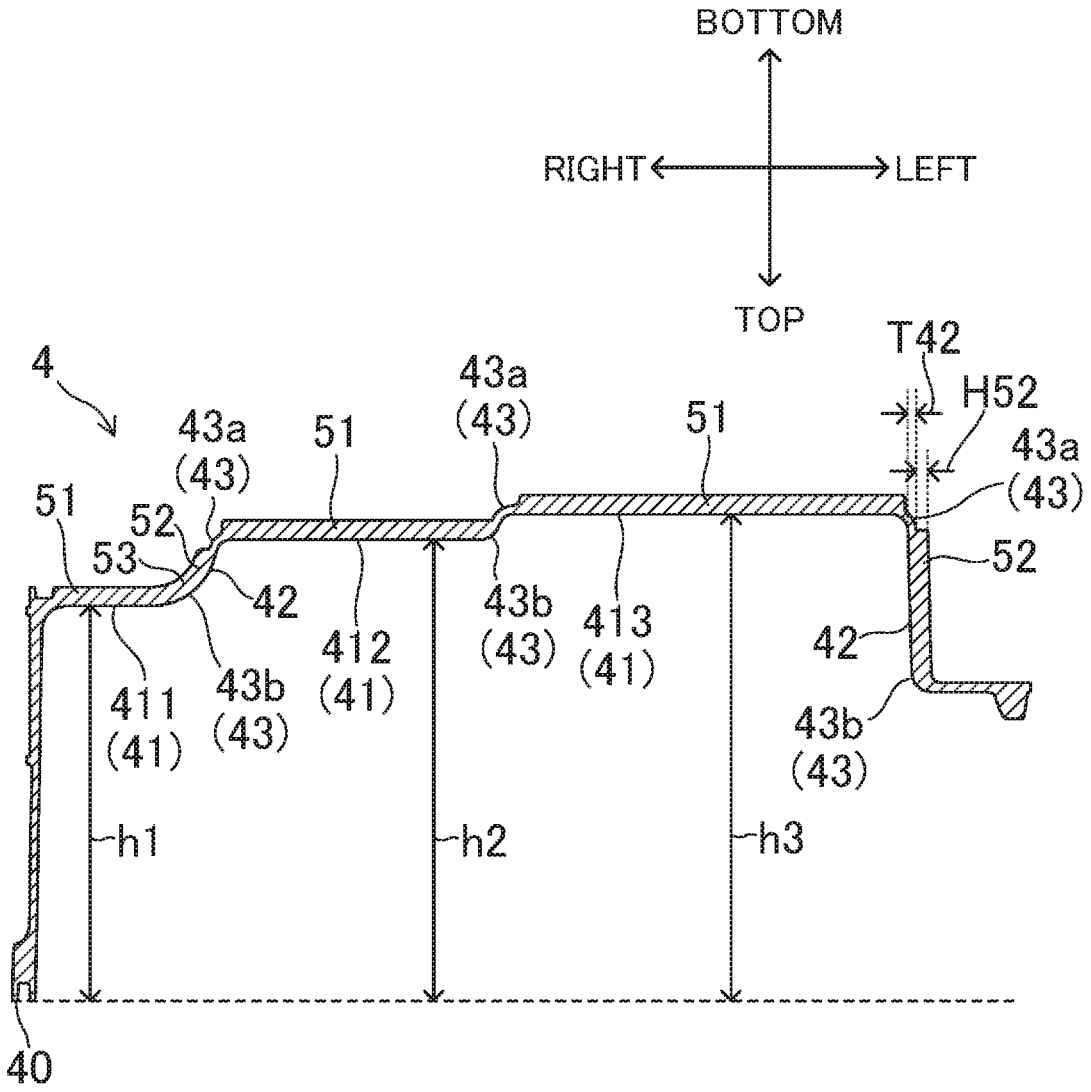
FIG. 7 is a cross-sectional view taken along the line VII-VII of FIG. 5.

As illustrated in FIGS. 3 to 8, the flat portion 41 is attached to the upper end of the oil pan 4, i.e., the lower end of the ladder frame 11*b*, and includes a plurality of flat regions each having a different distance from the lower end of the ladder frame 11*b*. Specifically, for example, as illustrated in FIGS. 7 and 8, the flat portion 41 includes a plurality of flat regions, namely, a first flat region 411, a second flat region 412, and a third flat region 413 having depths h1, h2, and h3, respectively, which are the distances from an upper end 40 of the oil pan 4. Such a plurality of flat regions can provide an oil pan 4 capable of compactly trapping oil in accordance with the engine layout. Each flat region has the first reinforcing ribs 51, and thus the flat portion 41 has improved strength.

Note that the height, width, and pitch of one of the first reinforcing ribs 51 may be identical to the height, width, and pitch of another continuous one of the first reinforcing ribs 51, or the height, width, and pitch may be different depending on location: e.g., the height gradually increases.

On an outer surface of the side wall portion 42, provided are a plurality of line-shaped second reinforcing ribs 52 arranged in parallel with each other in the substantially vertical direction along the outer surface of the side wall portion 42. Similarly to the first reinforcing ribs 51, the second reinforcing ribs 52 are for improving the strength of the oil pan 4. The shape of the second reinforcing ribs 52 may not be limited to the line shape but may also be another shape such as a grid shape, a honeycomb shape, or the like.

Note that when the oil pan 4 is made of resin and is molded by split-type mold molding, it is preferable that the first reinforcing ribs 51 are in a grid shape and the second reinforcing ribs 52 are in a line shape. This allows the first reinforcing ribs 51 to reinforce the flat portion 41 more effectively, and also allows the second reinforcing ribs 52 to reinforce the side wall portion 42 more effectively. Then, the releasability of the oil pan from the split-type mold is good, and the moldability can be improved.

As illustrated in FIG. 7, in the oil pan 4 according to this embodiment, a height H52 of the second reinforcing ribs 52, i.e., the height in the horizontal direction from the outer surface of the side wall portion 42 is 3 to 5 mm, which is approximately 1.2 times larger than a thickness T42 of the side wall portion 42 in the horizontal direction.

As illustrated in FIG. 6, in the oil pan 4 according to this embodiment, a width W52 of the second reinforcing ribs 52, i.e., the maximum width of the second reinforcing ribs 52 in the horizontal direction is approximately 1.2 times larger than the thickness T42 (see FIG. 7) of the side wall portion 42 in the horizontal direction.

Further, as illustrated in FIG. 6, in the oil pan 4 according to this embodiment, a pitch P52 of the second reinforcing ribs 52 is approximately five times larger than the width W52 of the second reinforcing ribs 52.

Figure 4:
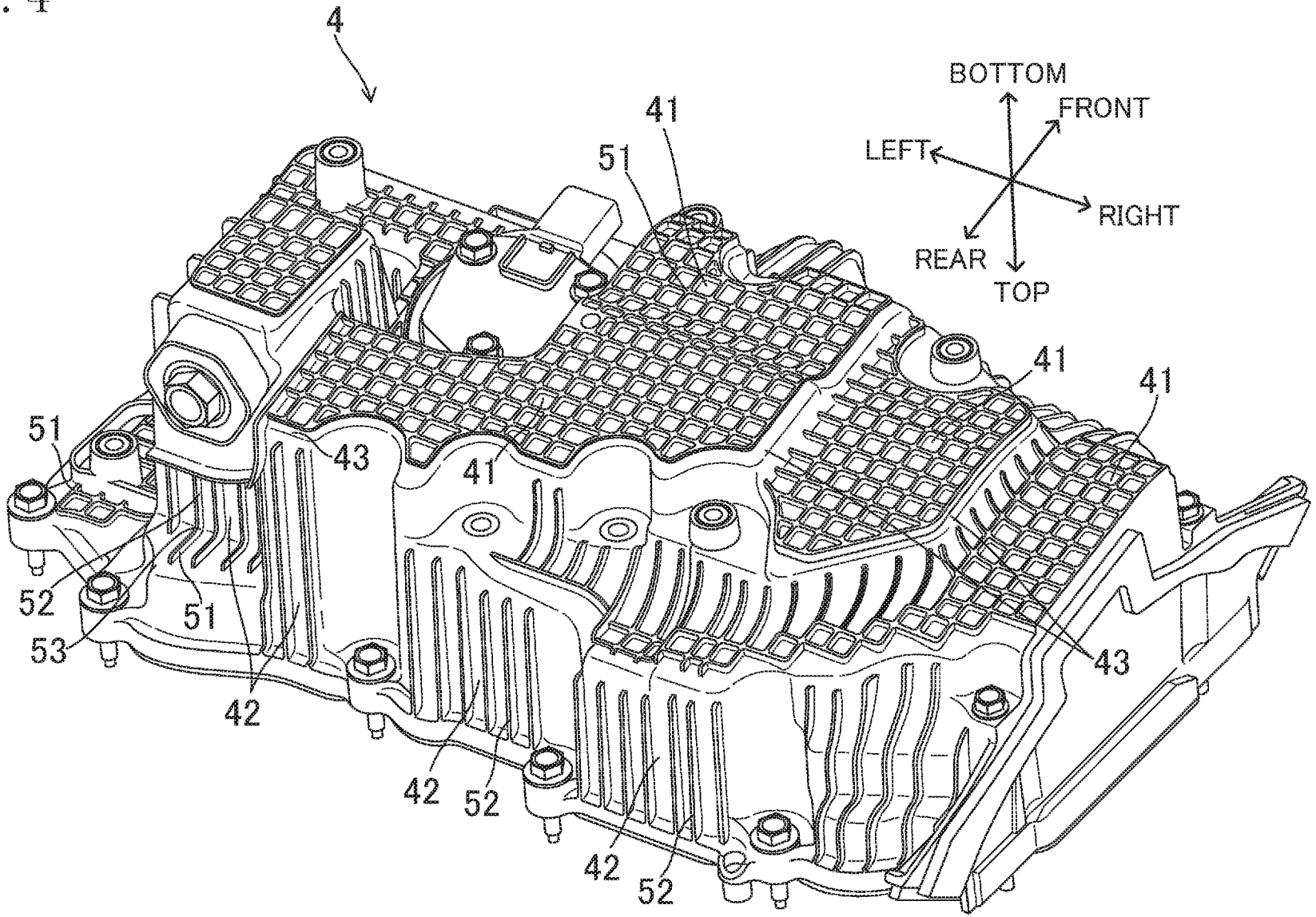
FIG. 4 is a perspective view of the oil pan of FIG. 3 as viewed from below on the rear right side.
Figure 5:
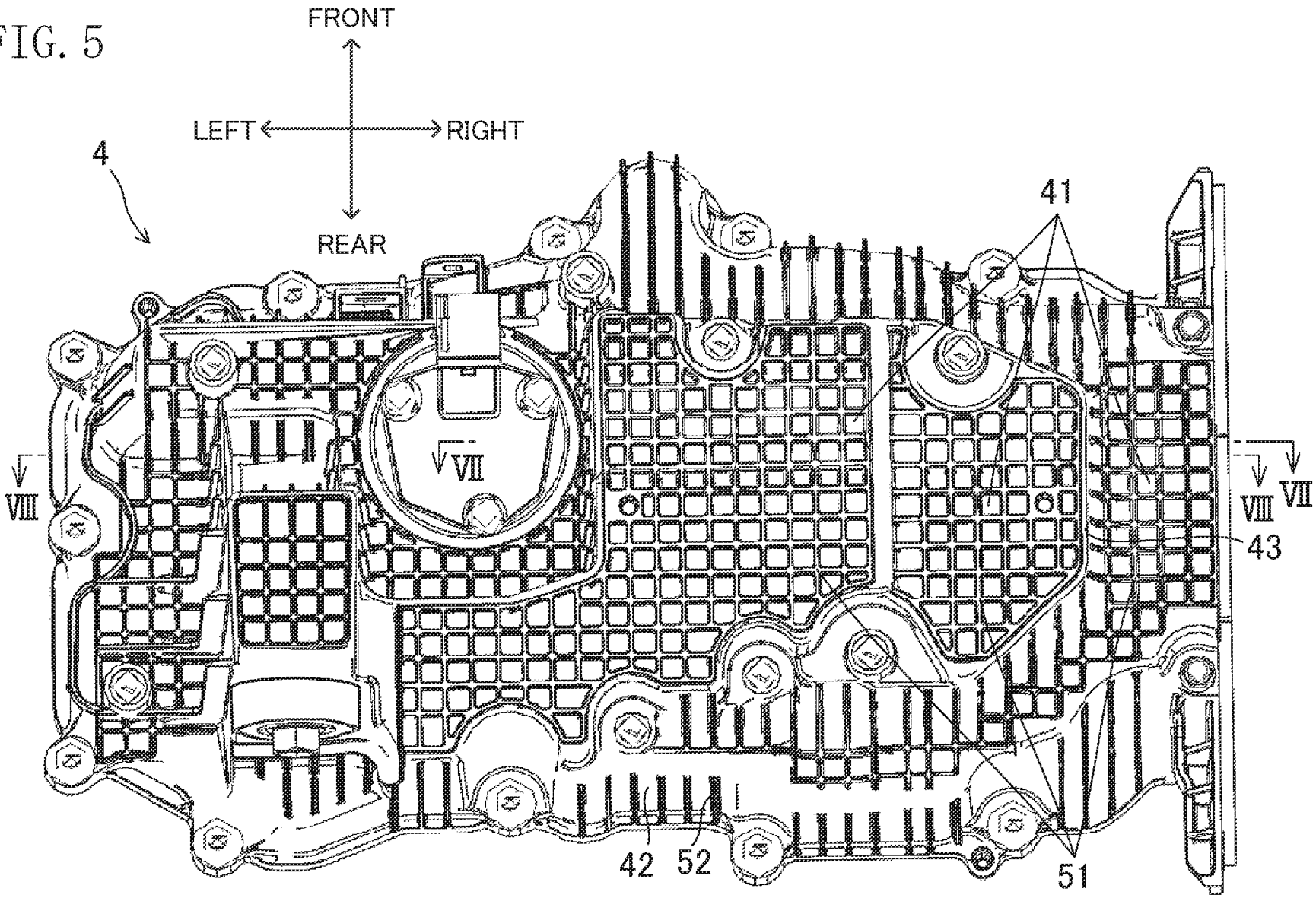
FIG. 5 is a perspective view of the oil pan of FIG. 3 as viewed from below on the rear side.

Note that the height, width, and pitch of the second reinforcing ribs 52 may be substantially identical to or different from those of the first reinforcing ribs 51. As illustrated in FIG. 4, the second reinforcing ribs 52 provided on the side wall portion 42 on the rear side of the oil pan 4 becomes slightly higher toward the upper end portion of the oil pan 4. As such, the height, width, and pitch of one of the second reinforcing ribs 52 may be different from those of another continuous one of the second reinforcing ribs 52 according to where the second reinforcing ribs 52 are formed, or the second reinforcing ribs 52 may have the identical height, width, and pitch over the entirety of the oil pan 4.

Here, the oil pan 4 according to this embodiment is characterized in that the curved portion 43 has an outer surface having a rib-free region 43*a* on which no reinforcing ribs are provided.

Specifically, as illustrated in FIGS. 7 and 8 in particular, the first reinforcing ribs 51 are provided on the outer surface of the flat portion 41. The second reinforcing ribs 52 are provided on the outer surface of the side wall portion 42. The curved portion 43 connecting the flat portion 41 and the side wall portion 42 includes the rib-free region 43*a* on which no reinforcing ribs are provided and a reinforcing rib forming region 43*b* on which third reinforcing ribs 53 are provided. The first reinforcing ribs 51 and the second reinforcing ribs 52 are not connected to each other at a portion where the rib-free region 43*a* of the curved portion 43 is present.

At the time of starting the engine 1, large vibration can occur in the engine body 10, and the temperature of the oil trapped in the oil pan 4 starts to increase. Then, the vibration transmitting to the oil pan 4 and the increase in the oil temperature cause large deformation of the oil pan 4. If the reinforcing ribs are provided continuously over the entire surface of the oil pan 4, i.e., over the flat portion 41 and the side wall portion 42 as in the technique described in Japanese Utility Model Publication No. H4-132445, the vibrations of the flat portion 41 and the side wall portion 42 are transmitted to each other through the reinforcing ribs, and this can cause larger deformation of the entirety of the oil pan 4. Then, the deformation of the oil pan 4 can cause an increase in the radiated sound.

In the oil pan 4 according to this embodiment, the curved portion 43 connecting the flat portion 41 and the side wall portion 42 includes the rib-free region 43*a*, and thus the transmission of vibrations between the flat portion 41 and the side wall portion 42 is reduced. Then, the deformation of the entirety of the oil pan 4 during the operation of the engine is reduced, and also the radiated sound generated with the deformation of the oil pan 4 can be reduced.

The rib-free region 43*a* of the curved portion 43 is formed to be curved in an outwardly raised manner. As described above, the flat portion 41 has the plurality of flat regions each having a different distance from the lower end of the cylinder block 11, i.e., a different depth h from the upper end of the oil pan 4, and thus the curved portion 43 connecting the plurality of flat regions includes a recessed portion facing toward the inside of the oil pan 4. As such, the recessed portion of the curved portion 43 is the reinforcing rib forming region 43*b*, and the third reinforcing ribs 53 are formed on the surface of the recessed portion. Specifically, for example, as illustrated in FIG. 7, the first flat region 411 and the second flat region 412 are connected by the recessed curved portion 43, the side wall portion 42 extending from the recessed curved portion 43, and the raised curved portion 43 extending from the side wall portion 42 to the second flat region 412. The third reinforcing ribs 53 extending from the first reinforcing ribs 51 formed in the first flat region 411 are formed in the recessed curved portion 43, and the recessed curved portion 43 is the reinforcing rib forming region 43*b*. Then, on the side wall portion 42, the second reinforcing ribs 52 are formed to extend from the third reinforcing ribs 53. In other words, the third reinforcing ribs 53 extend from the second reinforcing ribs 52 and are connected to the first reinforcing ribs 51. On the other hand, the raised curved portion 43 is not formed with the reinforcing ribs, and serves as the rib-free region 43*a*. Then, the second reinforcing ribs 52 provided on the side wall portion 42 and the first reinforcing ribs 51 provided on the second flat region 412 are not connected.

The curved portion 43 includes the outwardly raised curved portion having the rib-free region 43*a* where the first reinforcing ribs 51 and the second reinforcing ribs 52 are not connected to each other. This can effectively reduce the deformation of the oil pan 4 and reduce the radiated sound. On the other hand, the curved portion 43 is also curved to include the recessed portion facing toward the inside of the oil pan 4, the recessed portion having the reinforcing rib forming region 43*b* having the reinforcing ribs. This can improve the strength of the entirety of the oil pan 4, and easily enables metal molding.

If the first reinforcing ribs 51 and the second reinforcing ribs 52 are connected by the third reinforcing ribs 53 as illustrated in FIG. 7, the heights, the widths, and the pitches of these reinforcing ribs may be different but preferably identical in terms of the improvement in moldability. Thus, although not described in detail, the height, width, and pitch of the third reinforcing ribs 53 can be the same as those of the first reinforcing ribs 51 and the second reinforcing ribs 52.

Figure 3:
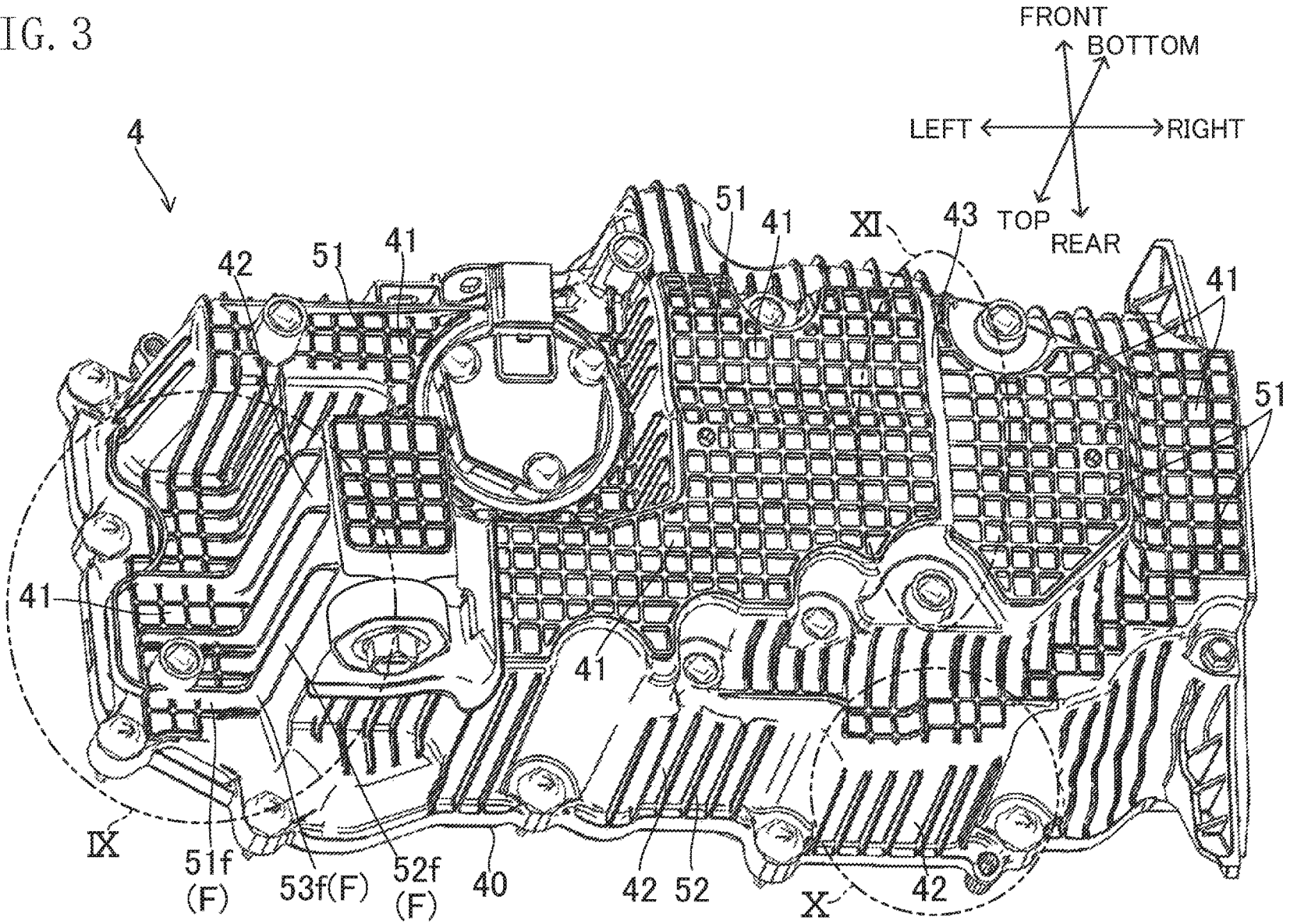
FIG. 3 is a perspective view of the oil pan according to one embodiment, as viewed from below on the rear left side.

As illustrated in FIGS. 3, 6, and 8, on the flat portion 41 and the side wall portion 42 located on the left side of the oil pan 4, i.e., located on the side opposite to the output side of the crankshaft 26 of the engine 1, provided are other reinforcing ribs, e.g., first large reinforcing ribs 51*f* and second large reinforcing ribs 52*f*, as the first reinforcing ribs 51 and the second reinforcing ribs 52, each having a rib height larger than that of the first reinforcing ribs 51, the second reinforcing ribs 52, and the third reinforcing ribs 53 provided on the front side, the rear side, and the center portion, etc. of the oil pan 4. The first large reinforcing ribs 51*f* and the second large reinforcing ribs 52*f* are connected by third large reinforcing ribs 53*f* provided in the reinforcing rib forming region 43*b* of the curved portion 43 formed to include the recessed portion facing toward the inside of the oil pan 4. In other words, L-shaped reinforcing ribs F each comprised of one of the first large reinforcing ribs 51*f*, one of the second large reinforcing ribs 52*f*, and one of the third large reinforcing ribs 53*f* are disposed on the left side of the oil pan 4. On the side opposite to the output side of the crankshaft 26 of the engine 1 of this embodiment, larger vibration and deformation tend to occur due to the support of the crankshaft 26 and the arrangement of the accessory drive system 60. According to the configuration described above, the L-shaped reinforcing ribs F each having a large rib height are provided on the left side of the oil pan 4. This can further increase the strength of the left side of the oil pan 4, effectively reduce the deformation of the oil pan 4, and reduce the radiated sound. The L-shaped reinforcing rib F can be located not only on the left side but also in an appropriate position where the larger vibration and deformation of the oil pan occur according to the configuration of the engine.

Figure 9:
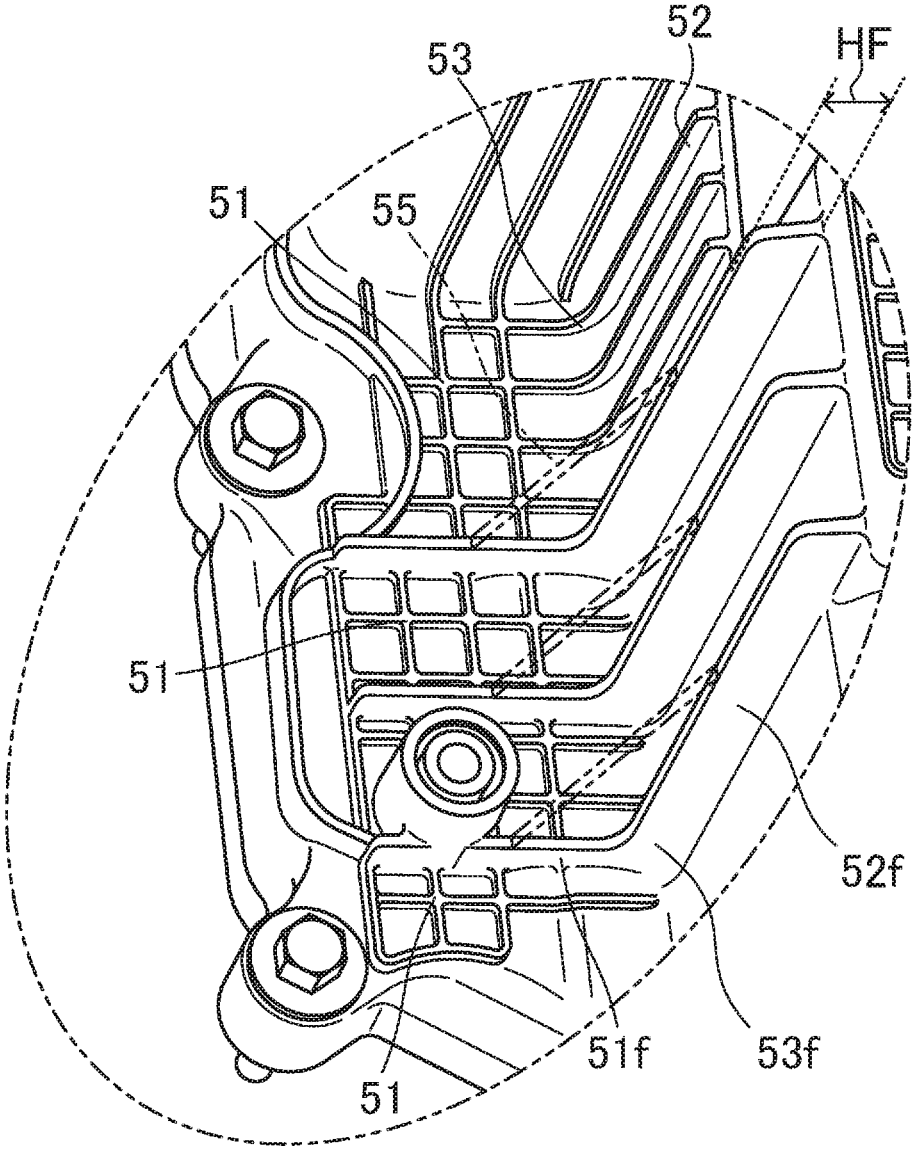
FIG. 9 is an enlarged view of a portion indicated by a reference character IX in FIG. 3.

As illustrated in FIGS. 6 and 9, a height HF, a width WF, and a pitch PF of the L-shaped reinforcing rib F are all set larger than the heights, the widths, and the pitches of the other reinforcing ribs. Although not intended to be limited, the height HF of the L-shaped reinforcing rib F can be a height of approximately 10 mm, and can be 1.5 times or more and 5 times or less the height H51 of the first reinforcing ribs 51, for example, in terms of the improvement in strength of the left side of the oil pan 4 and the weight reduction of the oil pan 4. Although not intended to be limited, the width WF of the L-shaped reinforcing rib F can be 1.5 times or more and 5 times or less the width W51 of the first reinforcing ribs 51, for example, in terms of the improvement in strength of the left side of the oil pan 4 and the weight reduction of the oil pan 4. Although not intended to be limited, the pitch PF of the L-shaped reinforcing rib F can be 1.5 times or more and 5 times or less the pitch P51 of the first reinforcing ribs 51, for example, in terms of the improvement in strength of the left side of the oil pan 4 and the weight reduction of the oil pan 4.

Other Embodiments

Other embodiments according to this disclosure will be described in detail below. In the descriptions of these embodiments, components equivalent to those of the first embodiment are denoted by the same reference characters, and the detailed descriptions thereof will be omitted.

As illustrated in FIG. 4 for example, the first reinforcing ribs 51 in the grid shape with substantially the same height, width, and pitch are formed on the plurality of flat regions of the flat portion 41 of the oil pan 4 according to the first embodiment. The second reinforcing ribs 52 in the line shape with substantially the same height, thickness, and pitch, except for the L-shaped reinforcing ribs F on the left side, are also formed in the side wall portion 42. The first reinforcing ribs 51 may adopt different configurations on the plurality of flat regions of the flat portion 41. That is, the first reinforcing ribs 51 may adopt different heights, widths, and pitches depending on the locations of the flat regions. The second reinforcing ribs 52 may adopt different heights, widths, and pitches also on the side wall portion 42 depending on the location of the side wall portion.

The oil pan 4 according to the first embodiment includes the inner surface on which no reinforcing ribs are provided, but the reinforcing ribs may also be formed on the inner surface of the oil pan 4. This further improve the strength of the oil pan 4.

EXAMPLES

The radiation energy of the oil pan at the time of starting the engine was studied by computer simulation analysis.

Figure 10:
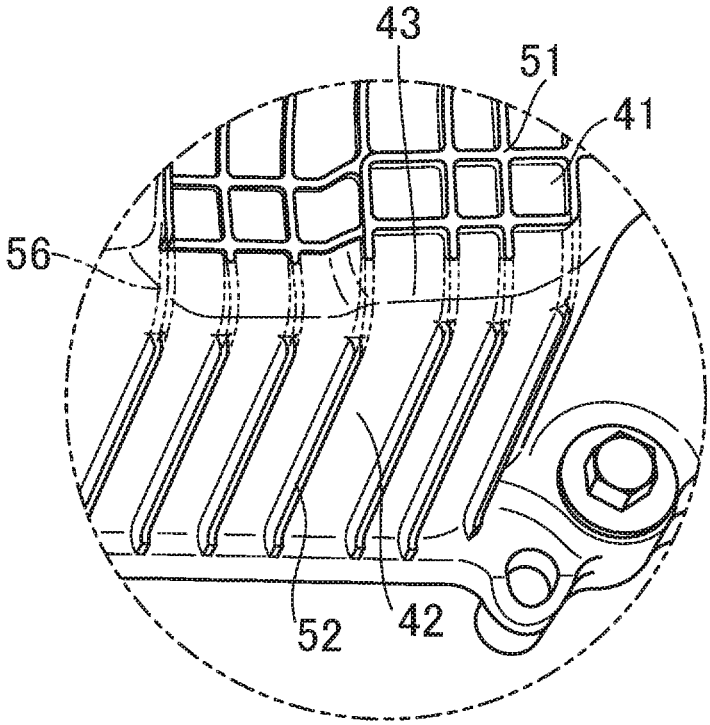
FIG. 10 is an enlarged view of a portion indicated by a reference character X in FIG. 3.
Figure 11:
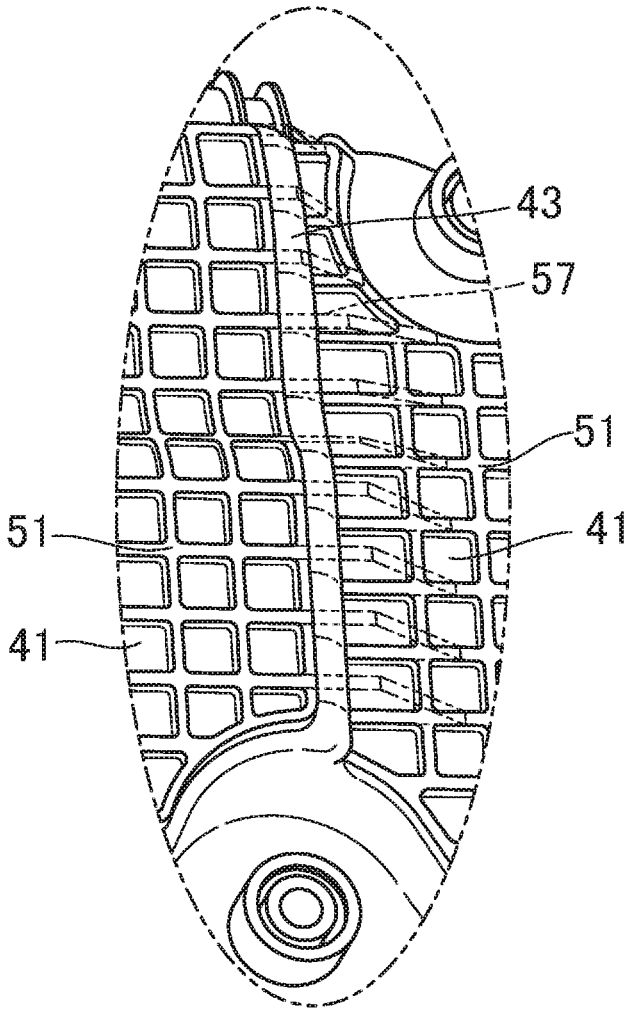
FIG. 11 is an enlarged view of a portion indicated by a reference character XI in FIG. 3.
Figure 12:
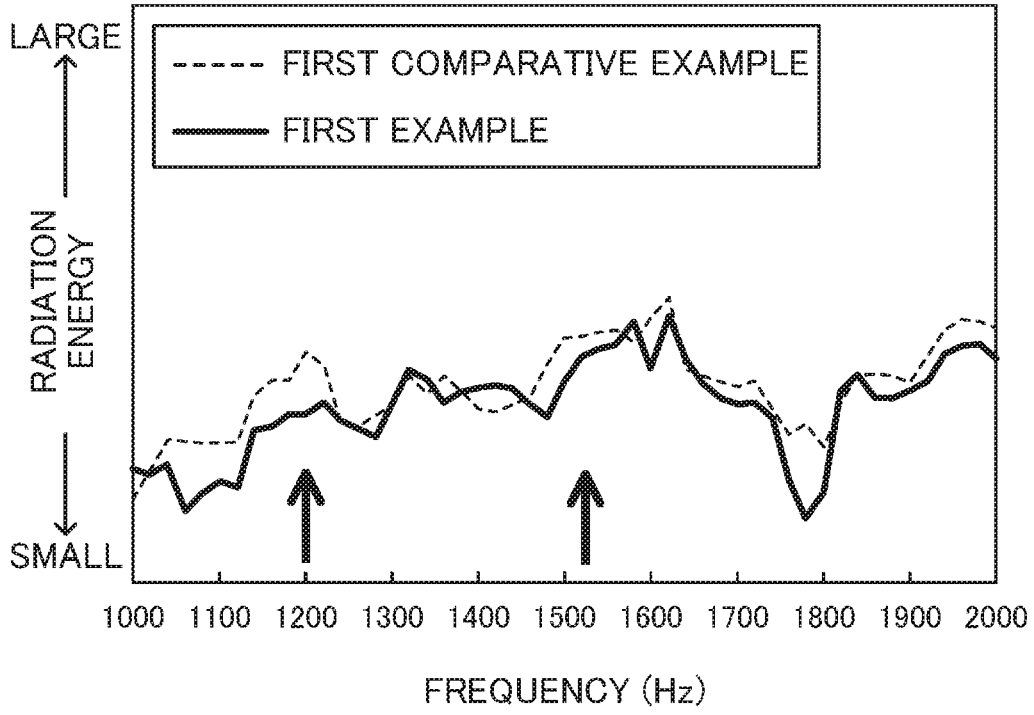
FIG. 12 is a graph showing the frequency dependence of radiation energy in a side wall portion on the front side of the oil pan.
Figure 13:
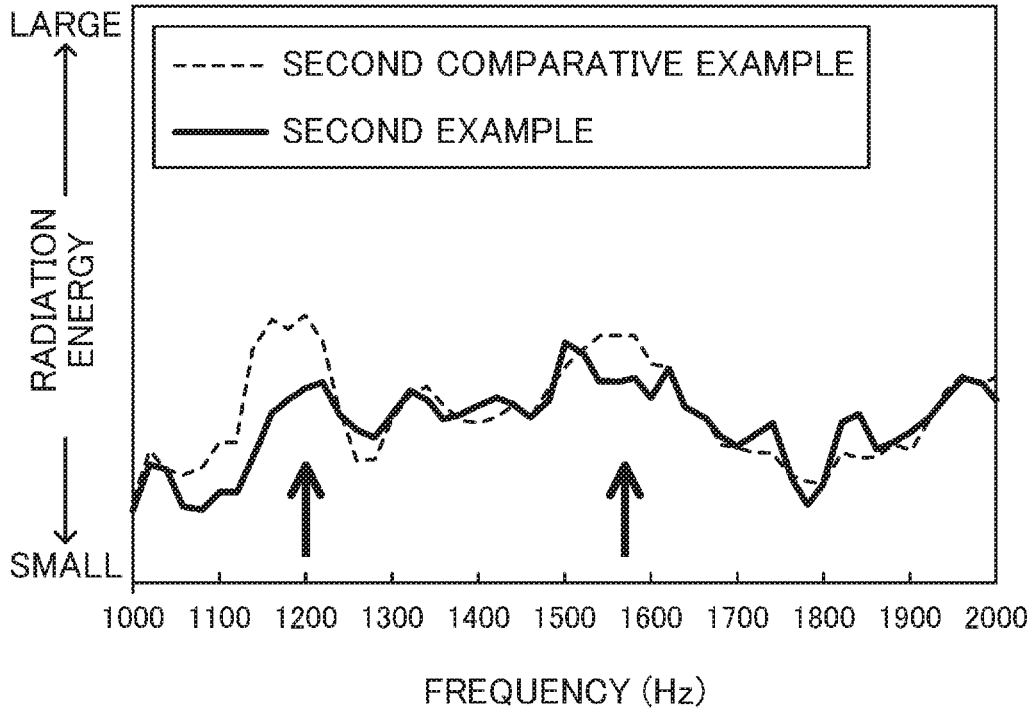
FIG. 13 is a graph showing the frequency dependence of radiation energy in the side wall portion on the rear side of the oil pan.
Figure 14:
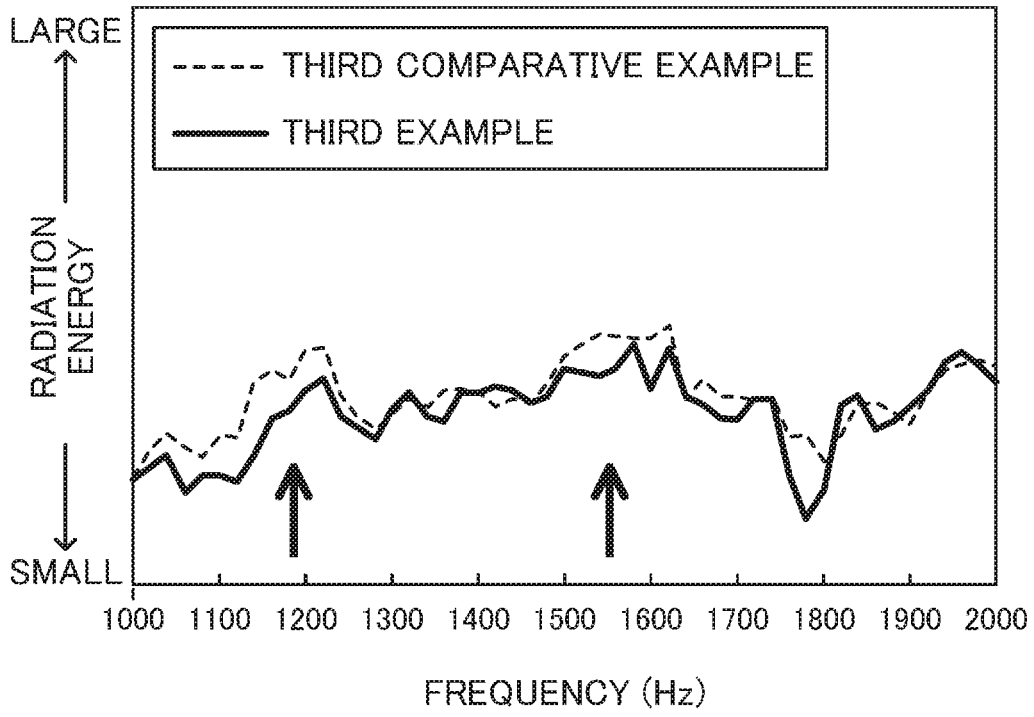
FIG. 14 is a graph showing the frequency dependence of radiation energy in a flat portion on the bottom side of the oil pan.
Figure 15:
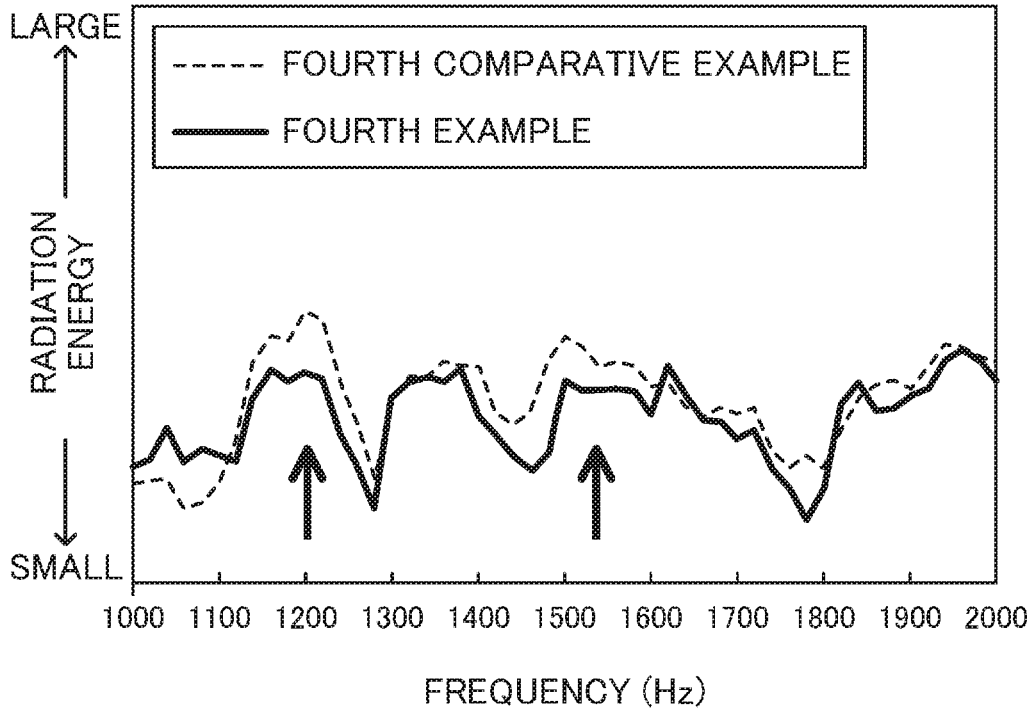
FIG. 15 is a graph showing the frequency dependence of radiation energy in the side wall portion on the left side of the oil pan.

FIGS. 12 to 15 show the analysis results. FIG. 12 shows a first example and a first comparative example to show the analysis results of the side wall portion on the front side of the oil pan. FIG. 13 shows a second example and a second comparative example to show the analysis results of the side wall portion on the rear side of the oil pan. FIG. 14 shows a third example and a third comparative example to show the analysis results of the side wall portion on the bottom side of the oil pan. FIG. 15 shows a fourth example and a forth comparative example to show the analysis results of the side wall portion on the left side of the oil pan. The first to fourth examples show the analysis results of the oil pan illustrated in FIG. 3. The first to fourth comparative examples show the analysis results of the oil pan having the configuration in which as illustrated in FIG. 9, triangular reinforcing ribs 55 are added to the positions of the third large reinforcing ribs 53*f* of the L-shaped reinforcing ribs F of the oil pan illustrated in FIG. 3, and in which as illustrated in FIGS. 10 and 11, curved portion reinforcing ribs 56, 57 are added on the rib-free region 43*a* of the oil pan illustrated in FIG. 3 to connect the first reinforcing ribs 51 and the second reinforcing ribs 52 or connect the first reinforcing ribs 51.

As shown by arrows in FIGS. 12 to 15, the radiation energy was lower around 1200 Hz and 1500 Hz to 1600 Hz in the first to fourth examples than in the first to fourth comparative examples. This shows that the radiated sound of the oil pan is reduced at the time of starting the engine in the first to fourth example compared to in the first to fourth comparative examples.

The present disclosure is extremely useful in the field of oil pan for trapping oil of an engine.

It should be understood that the embodiments herein are illustrative and not restrictive, since the scope of the invention is defined by the appended claims rather than by the description preceding them, and all changes that fall within metes and bounds of the claims, or equivalence of such metes and bounds thereof, are therefore intended to be embraced by the claims.

What is claimed is:

1. An oil pan for trapping oil, provided below a cylinder block of a multi-cylinder engine to extend to both ends of a cylinder line direction, the oil pan comprising:

a flat portion having a plurality of flat regions, the flat portion being formed to extend in a substantially horizontal direction and having an outer surface on which a plurality of line-shaped or honeycomb-shaped first reinforcing ribs are provided;

a curved portion smoothly connected to a peripheral portion of the flat portion, the peripheral portion surrounding the flat regions; and a side wall portion connected to a side, of the curved portion, opposite to the flat portion, extending in a substantially vertical direction, and having an outer surface on which a plurality of line-shaped second reinforcing ribs provided in parallel with each other in the substantially vertical direction along a surface of the side wall portion are provided, wherein the curved portion is a rib-free region on which no reinforcing ribs are provided, and the first reinforcing rib and the second reinforcing rib are not connected to each other in the rib-free region.

2. The oil pan of claim 1, wherein the flat regions of the flat portion each has a different distance from a lower end of the cylinder block.

3. The oil pan of claim 1, further comprising:

on the flat portion and the side wall portion located on a side opposite to an output side of a crankshaft of the engine, first large reinforcing ribs and second large reinforcing ribs, respectively, wherein the first large reinforcing ribs and the second large reinforcing ribs each has a rib height larger than those of the first reinforcing ribs and the second reinforcing ribs provided on a front side, a rear side, and a center portion of the oil pan.

4. The oil pan of claim 1, wherein the rib-free region of the curved portion is formed to be curved in an outwardly raised manner.

5. The oil pan of claim 1, wherein a part of the curved portion is curved to include a recessed portion facing toward an inside of the oil pan, and further has a reinforcing rib forming region having an outer surface on which third reinforcing ribs are formed, and the third reinforcing ribs extend from the second reinforcing ribs and are connected to the first reinforcing ribs.

* * * * *